United States Patent [19]

Jacobs, Jr.

[11] 4,048,610

[45] Sept. 13, 1977

[54] ELECTRIC PROTECTIVE DEVICE AND PROCESS OF MANUFACTURING THE SAME

[75] Inventor: Philip C. Jacobs, Jr., Newtonville, Mass.

[73] Assignee: Gould, Inc., Newburyport, Mass.

[21] Appl. No.: 710,251

[22] Filed: July 30, 1976

[51] Int. Cl.[2] ..... H01H 85/38

[52] U.S. Cl. ..... 337/165; 200/144 C; 337/273; 337/279

[58] Field of Search ..... 337/165, 166, 163, 164, 337/166, 273, 274, 276, 278, 279, 280, 281; 200/144 C, 149 A, 149 R

[56] References Cited

U.S. PATENT DOCUMENTS

| | | | |
|---|---|---|---|
| 2,321,711 | 6/1943 | Taylor | 337/165 |
| 3,810.062 | 5/1974 | Kozacka | 337/166 |
| 3,863,188 | 1/1975 | Knapp, Jr. | 337/164 |

*Primary Examiner*—Harold Broome
*Attorney, Agent, or Firm*—Erwin Salzer

[57] ABSTRACT

An electric protective device capable of handling both short-circuit currents and minor overload currents of impermissible duration. The device for interrupting small overload currents of impermissible duration includes a cylinder, a plunger inside said cylinder, a spring biasing said plunger, heater means, a solder joint conductively connected to said heater means and said plunger, and a body of material evolving gases under the heat of an arc surrounding said solder joint, adjacent portions of said plunger and adjacent portions of said heater means.

The process of manufacturing this device is preferably performed in two steps, namely arranging adjacent the solder joint of the device a sleeve-shaped body of melamine and an inorganic filler in a highly viscous putty-like form, and thereafter allowing said body to harden completely.

4 Claims, 2 Drawing Figures

ELECTRIC PROTECTIVE DEVICE AND PROCESS OF MANUFACTURING THE SAME

BACKGROUND OF THE INVENTION

This invention relates to a fusible protective device as used in electric fuses for interrupting overloads of excessive duration. Such devices include a cylinder, a plunger inside said cylinder, a helical spring having ends resting against said cylinder and plunger and biasing said plunger to move into said cylinder, and heating means conductively connected by a solder joint to said plunger. As long as the solder joint is not melted by the heat generated by said heating means, the plunger cannot move under the action of said helical spring. Upon fusion of the solder joint the plunger moves under the action of the helical spring into the cylinder, drawing an arc at the location where the solder joint had been. That arc is extremely difficult to extinguish, first because it is a low current arc wherein the backburn velocity of the arc terminals and consequently the arc voltage are minimal, and secondly because the plunger is a relatively large metal mass that evolves relatively large amounts of metal vapor which tend to ionize the arc path.

It is, therefore, the prime object of the invention to provide means which will quickly deionize the low current arc which occurs in devices under consideration.

Another object of the invention is to provide arc-extinguishing means which can readily be adapted to the complex interfaces which occur in such devices.

DESCRIPTION OF PREFERRED EMBODIMENT

Figure 1:
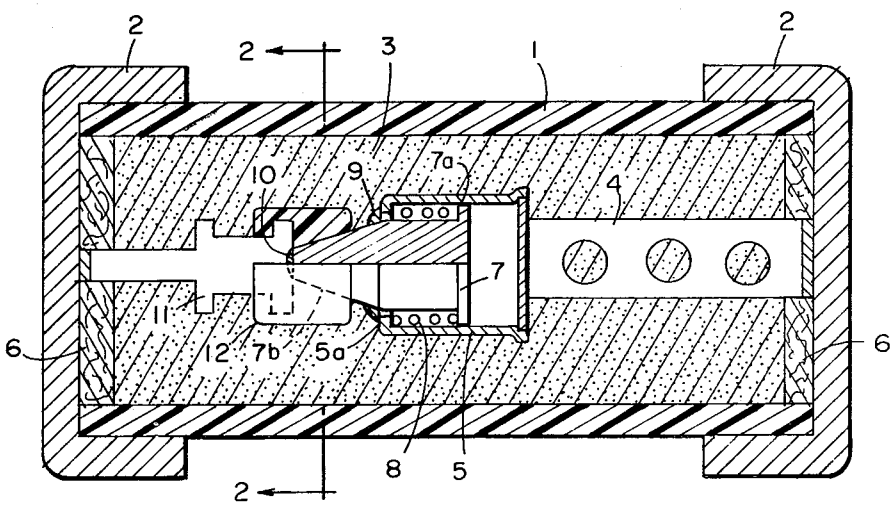
FIG. 1 is substantially a longitudinal section of a fuse embodying the present invention.
Figure 2:
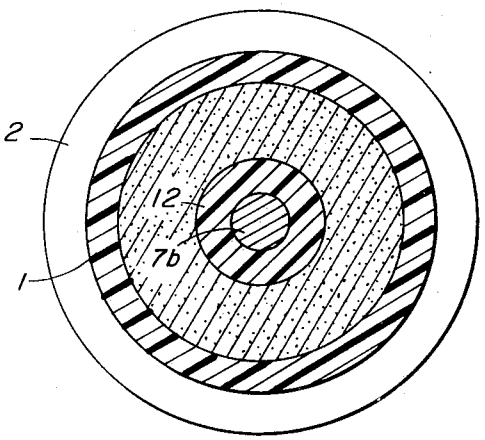
FIG. 2 is a cross-section of FIG. 1 along 2—2 of FIG. 1.

Referring now to the drawing, numeral 1 has been applied to indicate a casing of electric insulating material closed at the ends thereof by a pair of ferrules 2 and filled with a granular arc-quenching filler, e.g. quartz sand. A perforated fusible element 4 of copper or silver is connected on its left end to a cylinder 5 of a conductive material and on its right end to the right ferrule 2. Washers 6 of insulating material, e.g. asbestos, are interposed between filler 3 and ferrules 2. Fusible element 4 projects on the right end through right washer 6 and is clamped between the outer surface of casing 1 and the inner surface of right ferrule 2. This has not been shown in the drawings since it represents standard practice. Plunger 7 is arranged inside of cylinder 5. The helical spring 8 having ends resting against flanges **5*a* and 7*a* of cylinder 5 and plunger 7, respectively, biases plunger 7 to move into cylinder 5. The cylinder 5 and the plunger 7 are interconnected by an annular solder joint 9. The plunger 7 projects with its cone-shaped end 7*b* beyond cylinder 5, and the former is connected by solder joint 10 to an electric heater 11. The latter is formed by a substantially H-shaped piece of resistance material. The left end of heater 11 is conductively connected to left ferrule 2 in the same fashion as the right end of fusible element 4 is connected to right ferrule 2**.

A body 12 of material evolving gases under the heat of an arc surrounds solder joint 10, the cone-shaped end **7*b* of plunger 7, and the adjacent portions of heater means 11. Body 12** is an integral solid as distinguished from a granular or powdery material.

On occurrence of a short-circuit or a similar excessive fault current, fusible element 4 fuses and the resulting arc is quenched by the surrounding filler 3, thus resulting in interruption of the faulted circuit.

On occurrence of a relatively moderate overload of impermissible duration solder joints 9 and 10 fuse sequentially, allowing spring 8 to move plunger 7 from left to right. Consequently an arc is drawn at the point where solder joint 10 has previously been located. This arc causes a jet of gas to evolve from part 12 and to greatly dilute the arc. As a general rule the pressure generated at point 10 will be large enough to shatter part 12 into small fragments. This fragmentation of part 10 absorbs a great deal of energy and greatly increases the surface of part 12 capable of absorbing energy. As a result, the arc drawn between plunger 7 and heater 11 is rapidly extinguished.

Among the many materials that evolve gases under the heat of an arc mixture of melamine resins and inorganic additives are preferable. This is due to the fact that such mixtures are, or can be made to be, initially of highly viscous or putty-like character, and harden into solid substances, and that such mixtures undergo an ablation process under the heat of an arc which is rich in nitrogen and poor in carbon. Putty-like mixtures of melamine and inorganic additives have the property of sticking to most parts they come in contact with. This would inhibit moving a plunger 7 relative to cylinder 5 and drawing of an initial arc which furnishes the pressure for shattering part 12. Plunger 7 must be allowed to move away from heater 11 and this can be achieved by applying a releasing agent to the interface between plunger 7 and body 12 of gas-evolving material.

While I have described above the preferred embodiment of my invention, by invention is not limited thereto. One important aspect of the invention is to apply a mixture of melamine resins and inorganic fillers in a highly viscous putty-like form, in which it can readily be made to assume any desired shape such as, e.g. that of the complex interface between the conical end **7*a* of plunger 7 and heater 11. Thereafter that mixture is allowed to harden and to completely solidify. This change of state does not only make it possible to impart to body 12** complex shapes, but the subsequent break-up of the solid with its concomittant increase of surface greatly accelerates the ablation and deionization process.

I claim as my invention:

1. An electric protective device including in combination a. a cylinder;

b. a plunger inside said cylinder;

c. a helical spring having ends resting against said cylinder and said plunger and biasing said plunger to move into said cylinder;

d. heater means connected by a solder joint to said plunger; and e. a body of a material evolving gases under the heat of an arc in physical engagement with said solder joint, portions of said plunger, and portions of said heater means to evolve an arc-quenching jet of gas upon melting of said solder joint and initiation of an arc.

2. An electric protective device as specified in claim 1 wherein said material evolving gases under the heat of an arc is a melamine resin including inorganic additives.

3. An electric protective device as specified in claim 2 wherein the interface between said plunger and said body evolving gases under the heat of an arc is covered by a release agent.

4. A process of manufacturing an electric protective device including a cylinder, a plunger, a spring biasing said plunger relative to said cylinder, first solder means normally precluding relative movement of said plunger and said cylinder, a heater, second solder means conductively connecting said plunger and said heater, which process includes the steps of a. arranging adjacent to said heater a sleeve-shaped body of melamine and inorganic fillers in a highly viscous putty-like form, and thereafter b. allowing said body to harden completely to form a means for quenching the arc kindled upon melting of said second solder means and formation of a gap between said plunger and said heater.

* * * * *